US006822533B2

(12) United States Patent
Trammell et al.

(10) Patent No.: US 6,822,533 B2
(45) Date of Patent: Nov. 23, 2004

(54) FERRITE VARIABLE POWER DIVIDER

(75) Inventors: Christopher L. Trammell, La Habra, CA (US); Rolf Kich, Redondo Bch, CA (US)

(73) Assignee: The Boeing Company, Chicago, IL (US)

( * ) Notice: Subject to any disclaimer, the term of this patent is extended or adjusted under 35 U.S.C. 154(b) by 15 days.

(21) Appl. No.: 10/327,254

(22) Filed: Dec. 20, 2002

(65) Prior Publication Data

US 2004/0119550 A1 Jun. 24, 2004

(51) Int. Cl.[7] ..... H01P 5/12
(52) U.S. Cl. ..... 333/137; 333/125
(58) Field of Search ..... 333/125, 137, 333/136, 1.1, 24.2

(56) References Cited

U.S. PATENT DOCUMENTS 2,647,951 A * 8/1953 Zaleski ..... 333/108
2,649,575 A * 8/1953 Zaleski ..... 333/125
4,673,899 A * 6/1987 Jespersen et al. ..... 333/137

* cited by examiner

*Primary Examiner*—Stephen E. Jones
(74) *Attorney, Agent, or Firm*—Artz & Artz, PC

(57) ABSTRACT

A generally Y-shaped ferrite power divider for transferring an RF input from an input port to either one of two outlet ports or to both outlet ports in an equal or unequal fashion. The input port and the two output ports meet at a junction. An internal magnetic return is positioned in the junction and is in communication with an upper magnetic return and a lower magnetic return. An upper ferrite puck is positioned at the junction above the internal magnetic return and a lower ferrite puck is positioned at the junction below the internal magnetic return.

19 Claims, 3 Drawing Sheets

FERRITE VARIABLE POWER DIVIDER

TECHNICAL FIELD

The present invention relates generally to variable power splitters. More specifically, the present invention relates to a ferrite variable power splitter that allows for the unequal division of power between two ports.

BACKGROUND OF THE INVENTION

Variable power splitters (i.e., devices that provide 100% power to either of two ports or split the power equally between the two ports) have typically been achieved by means of mechanical switching mechanisms. These mechanical switching mechanisms are well known and were typically motor controlled. These devices therefore, require moving parts. Examples of such motor controlled switching mechanisms include the use of a vane inside of a tubular waveguide or a rotor having various waveguide paths machined therein. Because these prior variable power splitters have moving parts, they are relative complex and are susceptible to mechanical failure.

Ferrite switches are also well known. However, ferrite switches are not capable of splitting power between multiple outlets.

SUMMARY OF THE INVENTION

It is an object of the present invention to provide a variable power divider that is much simpler than prior variable power splitters.

It is another object of the present invention to provide a ferrite variable divider that allows for the unequal division of power between two outlet ports.

It is a further object of the present invention to provide a variable power divider that utilizes no moving parts.

In accordance with these and other objects of the present invention, a ferrite variable power divider is provided. The ferrite variable power divider includes an input port, a first outlet port, and a second outlet port. The input port, the first outlet port, and the second outlet port meet at a generally Y-shaped junction. The variable power divider includes an upper magnetic return and a lower magnetic return. The upper and lower magnetic returns are each in communication with an internal magnetic return positioned in the junction. The internal magnetic return has an upper surface and a lower surface. The upper surface is in magnetic communication with an upper ferrite puck, and the lower surface of the internal magnetic return is in communication with a lower ferrite puck. The configuration of the upper ferrite puck, and the lower ferrite puck and the internal magnetic return controls the amount of power that is transferred from the input port to each of the respective outlet ports.

Other objects and features of the present invention will become apparent when viewed in light of the detailed description of the preferred embodiment when taken in conjunction with the attached drawings and appended claims.

BRIEF DESCRIPTION OF THE DRAWINGS

FIG. 1(*b*) is a schematic cross-sectional view of the ferrite variable power divider of FIG. 1(*a*);

FIG. 2(*b*) is a schematic cross-sectional view of the ferrite variable power divider of FIG. 2(*a*);

FIG. 3(*b*) is a schematic cross-sectional view of the ferrite variable power divider of FIG. 3(*a*);

BEST MODE(S) FOR CARRYING OUT THE INVENTION

Figure 1A:
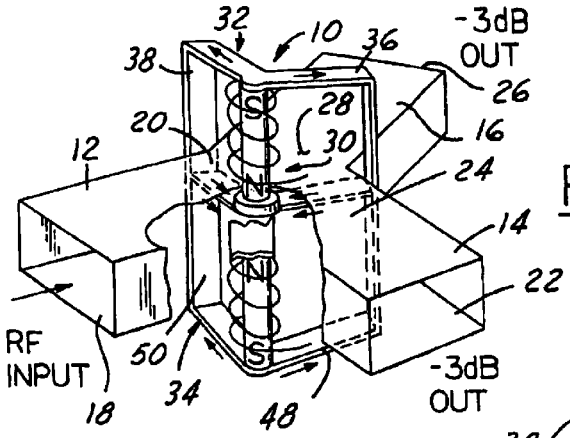
FIG. 1(*a*) is a perspective view of a ferrite variable power divider with an RF input being equally split between a first outlet port and a second outlet port in accordance with a preferred embodiment of the present invention.

Turning now to the Figures, which illustrate a preferred ferrite variable power divider 10 in accordance with the present invention. The ferrite variable power divider 10 is preferably generally "Y" shaped and has an input port 12, a first outlet port 14, and a second outlet port 16. The input port 12 has an inlet opening 18 and an exit opening 20. The first outlet port has an inlet opening 22 and an exit opening 24. The second outlet port has an inlet opening 26 and an exit opening 28. The input port exit opening 20, the first outlet port inlet opening 22, and the second outlet port inlet opening 26 all meet at a junction 30. As shown in the drawings, in the preferred embodiment, the ports 12, 14, and 16 are evenly distributed circularly about the junction 30 with 120° spacing between each of the ports. However, it should be understood that the power divider 10 may take on any number of different shapes or configurations, and the ports may be positioned at different locations and different angles with respect to one another. The arrows in each of the figures illustrate the direction of the magnetic paths.

The ferrite variable power divider 10 includes an upper magnetic return 32 and a lower magnetic return 34. The upper magnetic return 32 has a plurality of horizontal arms 36 and a plurality of vertical arms 38 in communication with the horizontal arms 36. The upper magnetic return 32 is in communication with an upper magnet 40 disposed within an electromagnetic coil 42 to effectuate the polarity of the upper magnet 40. Similarly, the lower magnetic return 34 is in communication with a lower magnet 44 disposed within an electromagnetic coil 46 to control the polarity of the lower magnet 44. The lower magnetic return 34 also includes a plurality of horizontal arms 48 and a plurality of vertical arms 50. The upper magnetic return 32 and the lower magnetic return 34 are preferably constructed of a metallic material, however, any other conductive material may be utilized.

An internal magnetic return 52 is preferably positioned at the junction 30. The internal magnetic return 52 is preferably a magnetically permeable three-legged arm with one arm spanning the input port exit opening 20, one arm spanning the first outlet port inlet opening 22, and the third arm spanning the second outlet port inlet opening 26. It should be understood that other configurations for the internal magnetic return 52 may be utilized. The internal magnetic return 52 is in communication with the vertical arms 38 of the upper magnetic return 32 and also in communication with the vertical arms 50 of the lower magnetic return 34.

Figure 1B:
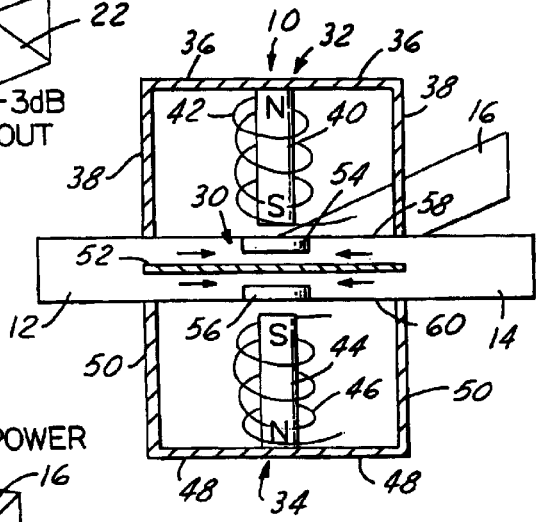

As shown in FIGS. 1(*a*) and 1(*b*), the internal magnetic return 52 is disposed between an upper ferrite puck 54 and a lower ferrite puck 56. In accordance with the present invention, the ferrite variable power divider 10 is electronically switchable. As discussed in more detail below, an RF input to the input port 12 can be switched so that 100% of the power goes through the first outlet port 14 and null power is received at the second outlet port 16. The divider can also be configured such that 100% power goes through the second outport port 16 and null power is received at the first outlet port 14. The power switching depends upon the orientation of the magnetic field as determined by the ferrite pucks 54, 56. In addition to switching 100% power from port to port, the power of the RF input can be switched equally between the two outlet ports 14, 16 such that −3 dB exits in each port. This is all done through the independently switchable ferrite pucks 54, 56 and the internal magnetic return 52.

Through the use of the internal magnetic return 52, the magnetic field created by the upper magnetic return 32 and the magnetic field created by the lower magnetic return 34 can be set independently and can be set in opposing magnetic polarities. As shown in FIGS. 1(*a*) and 1(*b*), the internal magnetic return 52 is positioned half way between the top 58 of the junction 30 and the bottom 60 of the junction 30. With this configuration, half the power from the RF input enters the upper ferrite puck 54 and the other half of the power enters the lower ferrite puck 56. In this embodiment, the upper ferrite puck 54 and the lower ferrite puck 56 are partially loaded such that they are in communication with the respective upper and lower walls 58 and 60 of the junction 30 and spaced a distance apart from the internal magnetic return 52. In this embodiment, the upper ferrite puck 54 and the lower ferrite puck 56 have the same thickness and are spaced the same distance from the internal magnetic return 52.

In the configuration shown in FIGS. 1(*a*) and 1(*b*), the lower ferrite puck 56 has circulating fields that provide isolation at the first outlet port 16 and full RF transmission at the second outlet port 16. The upper ferrite puck 54 provides isolation at the second outlet port 16 instead of the first outlet port 14, since its field is reversed. The upper ferrite puck 54 therefore provides full RF transmission at the first outlet port 14. Both the first and second outlet ports 14, 16, therefore provide −3 dB of the RF input power injected into the input ports 12 and 14.

Figure 2A:
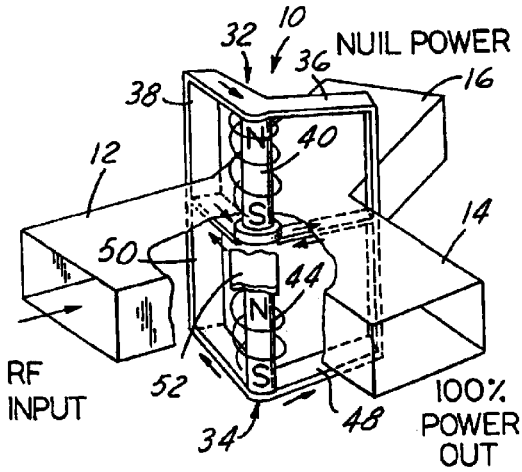
FIG. 2(*a*) is a perspective view of a ferrite variable power divider with an RF input being directed fully through one of a first outlet port or a second outlet port in accordance with the preferred embodiment of the present invention.
Figure 2B:
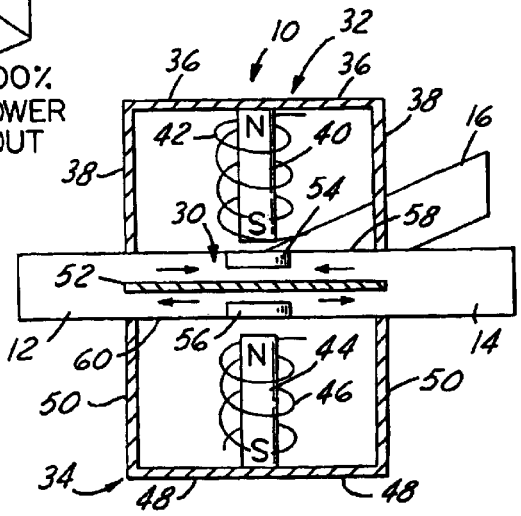

As shown in FIGS. 2(*a*) and 2(*b*), the upper and lower magnetic fields are set in the same polarity. The upper magnet 40 is positioned such that the north pole is located distal from the upper ferrite puck 56 while the south pole is in proximity to the upper ferrite puck 54. Conversely, the lower magnet 44 is configured such at its north pole is in proximity to the lower ferrite puck 56 and its south pole is positioned distal from the lower ferrite puck 56. In this configuration, the full RF input into the input port 12 is fully transmitted through the first outlet port 14 with zero or null power being transferred through the second outlet port 16.

Figure 3A:
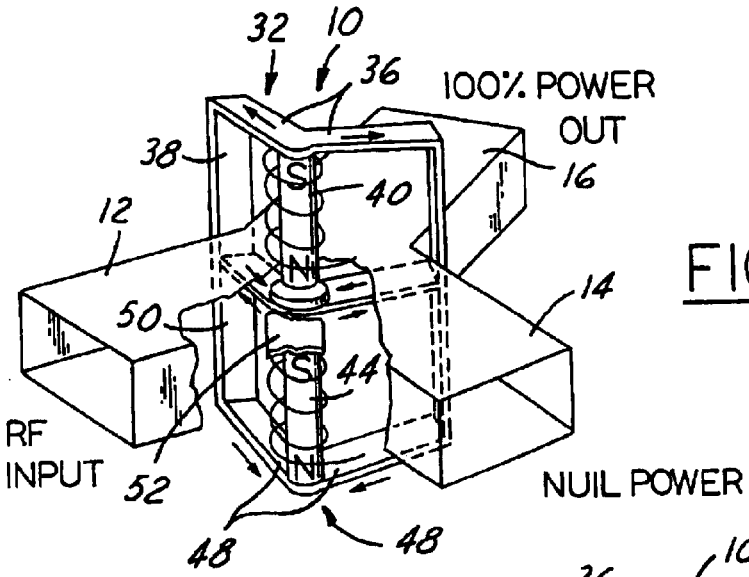
FIG. 3(*a*) is a perspective view of a ferrite variable power divider with an RF input being directed through one of a first outlet port or a second outlet port in accordance with another preferred embodiment of the present invention.
Figure 3B:
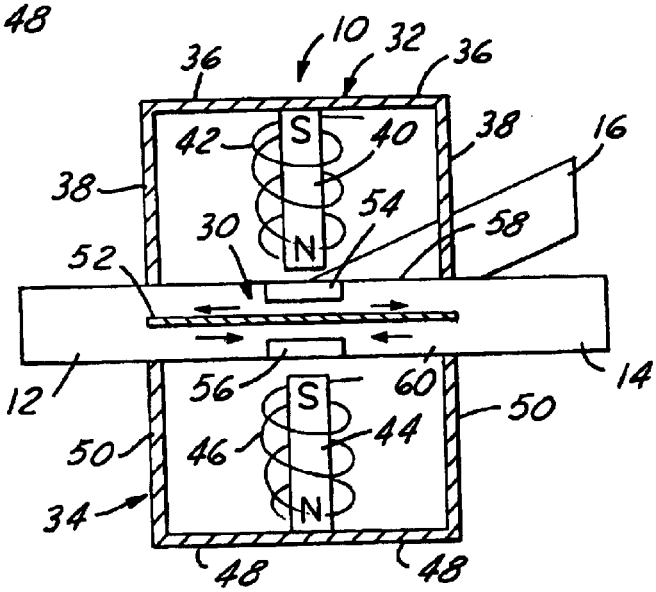

The opposite condition is shown in FIGS. 3(*a*) and 3(*b*). In this embodiment, the upper and lower fields are again set in the same polarity, however, the upper magnet 40 is configured such that its north pole is in close proximity to the upper ferrite puck 54 and its south pole is positioned distally with respect to the upper ferrite puck 54. Similarly, the lower magnet 44 is configured such that its south pole is in close proximity to the lower ferrite puck 56 and its north pole is positioned distally with respect to the lower ferrite puck 56. In this configuration, an RF input into the input port 12 of the ferrite variable power divider 10 is fully transmitted through the second outlet port 16 while zero or null power is transferred through the first outlet port 14.

Figure 4:
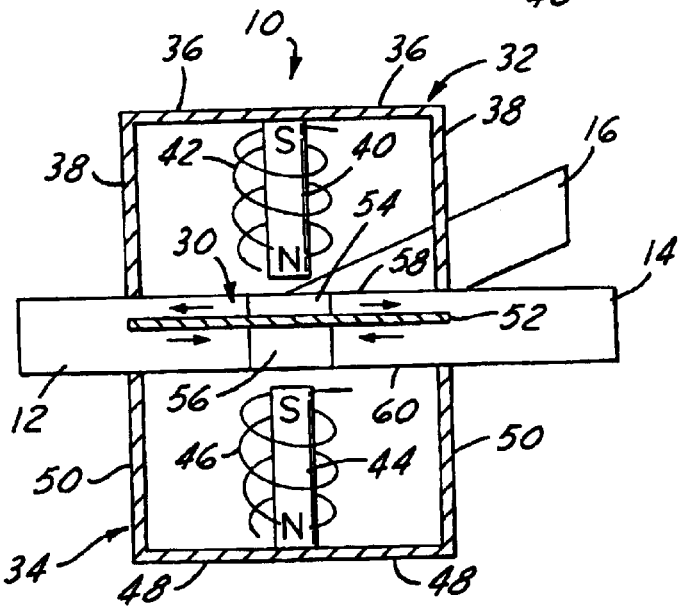
FIG. 4 is a schematic cross-sectional view of a ferrite variable power divider with an RF input being unequally divided between a first outlet port and a second outlet port in accordance with a preferred embodiment of the present invention.

Turning now to FIG. 4, which illustrates another preferred embodiment in accordance with the present invention. In this embodiment, the upper ferrite puck 54 and the lower ferrite puck 56 are fully loaded such that the upper ferrite puck 54 is disposed fully between the upper wall 58 of the junction 30 and the internal magnetic return 52. Similarly, the lower ferrite puck 56 is disposed fully between the lower wall 60 of the junction 30 and the internal magnetic return 52. In this embodiment, the internal magnetic return 52 is positioned such that it is closer to the upper wall 58 of the junction 30 than it is to the lower wall 60 of the junction 30. Thus, the upper ferrite puck 54 is thinner than the lower ferrite puck 56. In this embodiment, with fully loaded pucks, and an internal magnetic return 52 that is biased off center, the 50% power split can be varied.

In the embodiment shown in FIG. 4, the power for the RF input is split such that 70% of the input is transferred to the first outlet port 14 while 30% of the RF input is transferred to the second outlet port 16. However, it should be understood that different percentages may be achieved by changing the height of the ferrite pucks 54, 56 as well as the relative bias off center of the internal magnetic return path 52. These can all be achieved through experimentation as would be well known by one of ordinary skill in the art.

Figure 5:
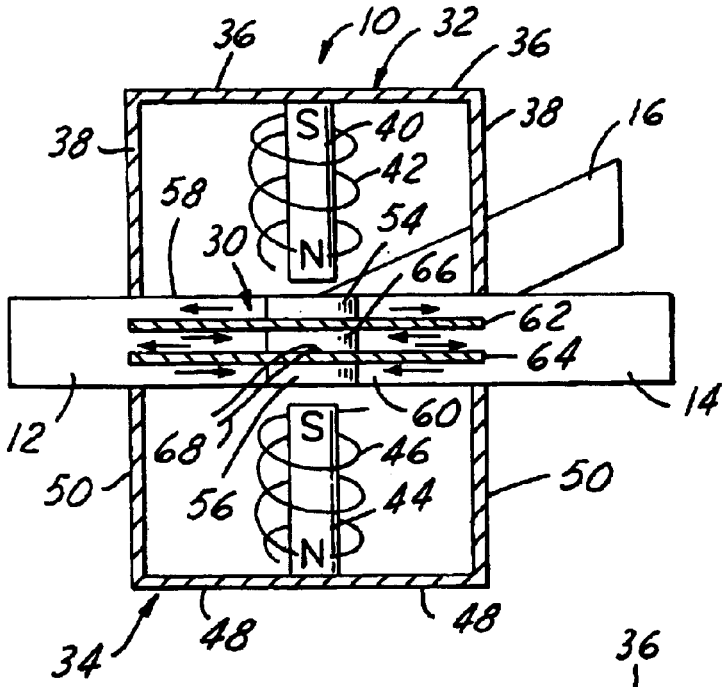
FIG. 5 is a schematic cross-sectional view of a ferrite variable power divider with an RF input being unequally divided between a first outlet port and second outlet port in accordance with another embodiment of the present invention.

Turning now to FIG. 5, which illustrates another ferrite variable power divider 10 in accordance with the present invention. In FIG. 5, multiple internal magnetic returns are provided at the junction 30. In this embodiment, a first internal magnetic return 62 is positioned above a second internal magnetic return 64. The upper ferrite puck 54 is fully loaded between the upper wall 58 of the junction 30 and the first internal magnetic return 62. Similarly, the lower ferrite puck 56 is fully loaded between the lower wall 60 of the junction 30 and the second internal magnetic return 64. A middle ferrite puck 66 is fully loaded and fully disposed between the first internal magnetic return 62 and the second internal magnetic return 64. A loop energizer 68 in the form of a single wire is passed into the junction 30 to apply high current pulses thereto.

Through the use of the loop energizer 68, the ferrite pucks 54, 56, and 66, together with the internal magnetic returns 62 and 64, the power can be unequally split between the first outlet port 14 and the second outlet port 16. For example, FIG. 5 illustrates a 30% power output through the second outlet port 16 and a 70% power output through the first outlet port 14. The use of loop energizers 68 are well known in the art. However, the use of an internal loop energizer 68 at the junction 30 together with the external energizers in the form of the upper and lower magnetic returns 32 and 34 provide unique variable power splitting.

Figure 6:
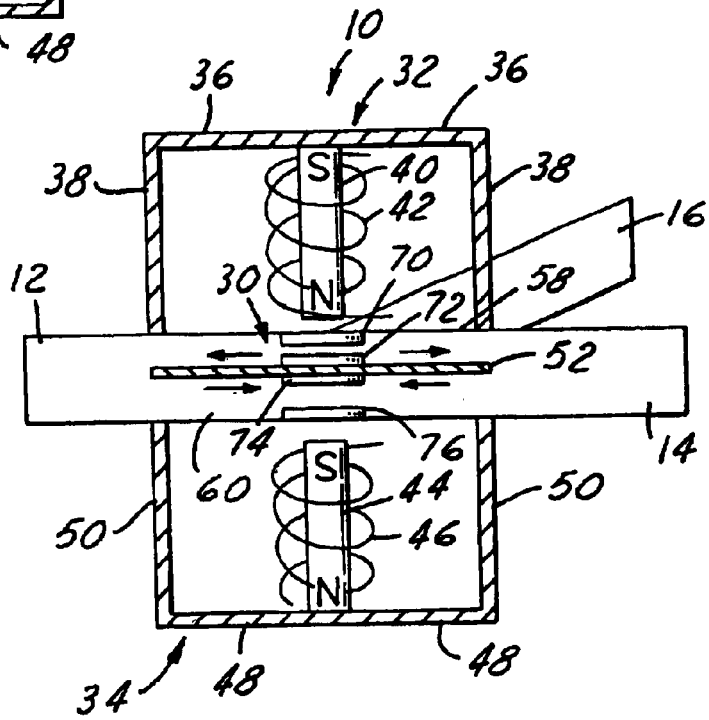
FIG. 6 is a schematic cross-sectional view of a ferrite variable power divider with an RF input being unequally divided between a first outlet port and a second outlet port in accordance with another preferred embodiment of the present invention.

Turning now to FIG. 6, which illustrates another preferred ferrite variable power divider 10 in accordance with the present invention. As shown in FIG. 6, four ferrite pucks are positioned at the junction 30. A first upper ferrite puck 70 is partially loaded and in communication with the upper wall 58 of the junction 30. A second upper ferrite puck 72 is partially loaded and positioned above the internal magnetic return 52. A first lower ferrite puck 76 is partially loaded and positioned below the internal magnetic return 52. A second lower ferrite puck is partially loaded and positioned in contact with the lower wall 60 of the junction 30. If the thickness of the pucks 70, 72, 74, and 76 are designed to be equal and the internal magnetic return 52 is placed half way between the upper wall 58 and the lower wall 60 of the junction 30, the power split will be divided equally such that it is −3 dB at each port. However, if the magnetic return 52 is biased off center and the pucks have unequal thickness as is shown in FIG. 6, the power split can be varied such that it is unequally divided between the first outlet port 14 and the second outlet port 16.

While the best modes for carrying out the invention have been described in detail, those familiar with the art to which this invention relates will recognize various alternative designs and embodiments for practicing the invention as defined by the following claims.

What is claimed is:

1. A variable power divider, comprising:

an inlet port;

a first outlet port;

a second outlet port;

said inlet port, said first outlet port, and said second outlet port having a common junction;

an internal magnetic return positioned at said junction, said internal magnetic return having a first surface and a second surface;

an upper magnetic return in communication with said internal magnetic return;

a lower magnetic return in communication with said internal magnetic return;

an upper ferrite puck in magnetic communication with said first surface of said internal magnetic return; and a lower ferrite puck in magnetic communication with said second surface of said internal magnetic return.

2. The variable power divider of claim 1, further comprising an upper electromagnetic coil surrounding an upper magnet and a lower electromagnetic coil surrounding a lower magnet.

3. The variable power divider of claim 2, wherein said upper magnet and said lower magnet have the same polarity in proximal relation to said respective upper and lower ferrite pucks causing an RF input into said input port to be equally divided between said first outlet port and said second outlet port.

4. The variable power divider of claim 2, wherein said upper magnet and said lower magnet have opposite polarities in proximal relation to said respective upper and lower ferrite pucks causing an RF input to be fully directed to either said first outlet port or said second outlet port.

5. The variable power divider of claim 2, wherein said upper ferrite puck and said lower ferrite puck are of equal thickness.

6. The variable power divider of claim 5, wherein said upper ferrite puck is spaced a predetermined distance from said first surface of said internal magnetic return and said lower ferrite puck is spaced the same predetermined distance from said second surface of said internal magnetic return.

7. The variable power divider of claim 2, wherein said upper ferrite puck is fully loaded and said lower ferrite puck is fully loaded and wherein said upper ferrite puck and said lower ferrite pucks have different relative thickness.

8. The variable power divider of claim 7, wherein said internal magnetic return is positioned closer to said magnetic return associated with the thinner of said upper or lower ferrite puck.

9. The variable power divider of claim 2, wherein one of said upper ferrite puck or said lower ferrite puck is in communication with a loop energizer.

10. The variable power divider of claim 2, further comprising an additional ferrite puck located on said first surface of said internal magnetic return and spaced apart from said upper ferrite puck; and an additional ferrite puck located on said second surface of said internal magnetic return and spaced apart from said lower ferrite puck.

11. The variable power divider of claim 10, wherein said lower ferrite puck has a thickness greater than said upper ferrite such that an RF input into said input port is divided unequally between said first outlet port and second outlet port.

12. A ferrite variable power divider, comprising:

an inlet passage having an inlet opening and an exit opening;

a first outlet port having an inlet opening and an exit opening;

a second outlet port having an inlet opening and an exit opening;

a junction wherein said inlet passage exit opening, said first outlet opening inlet opening, and said second outlet port exit opening meet;

an internal magnetic return positioned at said juncture and having an upper surface and a lower surface;

an upper ferrite puck positioned in said junction above said internal magnetic return;

a lower ferrite puck positioned in said junction below said internal magnetic return;

an upper magnet in communication with said upper ferrite puck and an upper magnetic return; and a lower magnet in communication with said lower ferrite puck and a lower magnetic return.

13. The ferrite variable power divider of claim 12, wherein said upper ferrite puck and said lower ferrite puck are each fully loaded.

14. The ferrite variable power divider of claim 13, wherein said upper ferrite puck and said lower ferrite puck have different thicknesses.

15. The ferrite variable power divider of claim 12, wherein said upper ferrite puck and said lower ferrite puck are each partially loaded.

16. The ferrite variable power divider of claim 15, wherein said upper ferrite puck and said lower ferrite puck have different thicknesses.

17. The ferrite variable power divider of claim 12, wherein one of said upper or lower ferrite pucks is in communication with a loop energizer.

18. The ferrite variable power divider of claim 12, wherein said pucks are positioned equidistant from one another.

19. The ferrite variable power divider of claim 12, wherein said internal magnetic return has three legs.

* * * * *